United States Patent [19]

Hanke

[11] 4,082,600

[45] Apr. 4, 1978

[54] FILM SPLICING APPARATUS

[75] Inventor: Rudolph Hanke, Monheim, Schwaben, Germany

[73] Assignee: Hamma Hamaphot KG., Hanke & Thomas, Monheim, Schwaben, Germany

[21] Appl. No.: 808,193

[22] Filed: Jun. 20, 1977

[30] Foreign Application Priority Data

Jul. 3, 1976 Germany ..... 2629985

[51] Int. Cl.[2] ..... B31F 5/00

[52] U.S. Cl. ..... 156/505

[58] Field of Search ..... 156/505, 506

[56] References Cited

U.S. PATENT DOCUMENTS

| | | | |
|---|---|---|---|
| 3,716,444 | 2/1973 | Hanke | 156/505 |
| 3,764,440 | 10/1973 | Schroter et al. | 156/505 |
| 3,873,401 | 3/1975 | Gustafson | 156/505 |
| 3,914,491 | 10/1975 | Takahashi | 156/505 |

*Primary Examiner*—Douglas J. Drummond

*Attorney, Agent, or Firm*—Ross, Ross & Flavin

[57] ABSTRACT

Film splicing apparatus, for splicing together the ends of two films using an adhesive foil incorporating a tear-off strip and supported on carrier paper strips, comprises a base having a hinged lid and carrying a flat flap which is swingable through 180° to an inverted position, which has therein a window which in an initial position of the flap receives a projection projecting upwardly from the base, and which has prongs for engagement thereon of the carrier paper strip, the flap carrying a pin which extends parallel to the swinging axis of the flap and traverses the window, there being a shoulder on the base, this shoulder providing a ledge extending parallel to the flap's swinging axis and an upstanding edge which is spaced from the swinging axis by a distance just slightly greater than half the length of the tear-off strip, the top of the shoulder being level with the bottom surface of a depression in the top of the base, and the upstanding edge providing an abutment surface which serves to cause erection of the free limb of the foil.

6 Claims, 9 Drawing Figures

20
46
27
21
33
43
45
41
A
1
6
25
30
24
22
66
51
61
D
34
A
37
38
42
44
26
19
31
23
6
2
39
40
32
L
48
50
49
IX

FILM SPLICING APPARATUS

BACKGROUND OF THE INVENTION

This invention concerns a film splicing apparatus.

Adhesive foils have been developed for splicing together the ends of films, which foils, prior to use, are supported on strips of carrier paper. To produce a spliced joint, the adhesive foil is folded in hairpin configuration around the abutting film ends that are to be connected in such a way that it abuts by an adhesive surface on each limb thereof against opposite sides of the film ends. If a sound track is present on the film ends that are to be connected, then, upon the production of the spliced joint, the sound track is masked at the joint by the adhesive foil. Because this is undesirable, adhesive foils have been developed in which, after production of the joint, the bight portion of the foil can be detached to such an extent that the sound track, which would have been covered thereby, is not masked and that the edges of the film ends, which would otherwise be enclosed by the bight portion of the foil, are completely free from adhesive foil.

The problem underlying the present invention is to provide a film splicing apparatus by means of which spliced joints can be produced in an almost completely mechanical manner using adhesive foils having tear-off strips which are supported, prior to use, on strips of carrier paper and which can be folded in hairpin configuration around the abutting film ends.

SUMMARY OF THE INVENTION

To solve this problem, a start is made from splicing apparatus comprising a base carrying a hinged lid and a flat flap which is mounted on the base, which can be swung to a reversed or inverted position, which is formed with a window and which embodies a film guide and accommodates a projection projecting upwards from the top of the base and, in an initial position of the flap, projecting into the window, and which has upwardly-projecting prongs for engagement thereon of the carrier paper strips. In such a film splicer, the invention is characterised in that a pin is provided on the flap so as to extend approximately parallel to the swinging axis of the flap and to transverse the window, and in that, contemplated from the swivel axis, a ledge is present on that side, which lies opposite the projection, of a shoulder of the base, said ledge extending approximately parallel to the swivel axis and having a substantially vertically-upwardly extending edge, the spacing of said edge from the swivel axis of the flap being greater, by the thickness of the adhesive foil, and by a slight clearance, for example of the order of magnitude of the thickness of writing paper, than the greatest spacing of the pin from the swivel axis of the flap, which spacing corresponds approximately to half the length of the tear-off strip, the top surface of the shoulder being approximately in a common plane with the bottom of a depression in the top of the base and in which the vertically-upwardly-extending edge serves as a stop which, in operation of the apparatus, brings about the erection of a free limb of the adhesive foil.

Because of this construction of the apparatus, the adhesive foil is bent upwards, upon swinging of the flap through 180° from its initial position, into its inverted position so that its part which forms the tear-off strip, curves about the pin through an angle of about 90°.

For completing bending-over of the adhesive foil into the hairpin shape, the apparatus is advantageously further characterised in that mounted for swinging movement on the shoulder is a presser which serves to bend-over the free limb of the adhesive foil into the hairpin shape, which presser, when the flap is swung through 180° from its initial position, freely penetrates the window thereof and carries a pressure stirrup which is mounted for swinging movement on the presser and is under the action of a spring which forces it outwardly and has a shoe and is swingable with its shoe, against the action of a spring, towards the ledge serving for the erection of the free limb of the adhesive foil, whereby the shoe initially comes into abutment against the free limb of the adhesive foil and upon the further swinging of the presser in the same direction bends the free limb over into the hairpin shape and slides over the bent-over limb while pressing thereon.

Also, the detaching of the tear-of strip may be effected mechanically if the film splicer of the invention is characterised in that situated on the presser is a rigid wedge the tip of which points towards the top surface of the shoulder and which co-operates with an upwardly-open groove provided in the shoulder in such a way that, upon the swinging of the presser in the direction of the swivel axis of the flap after bending over of the free limb of the adhesive foil, and after pressing thereof onto the films by a shoe, it penetrates into the groove thereby detaching the tear-off strip, encircling the pin, from the rest of the adhesive foil.

In constructional respects, it is advantageous if the presser is hollow in form and a web integral with its back wall terminates in the wedge.

BRIEF DESCRIPTION OF THE DRAWINGS

The invention will be described further, by way of example, with reference to the accompanying drawings, in which.

Figure 1:
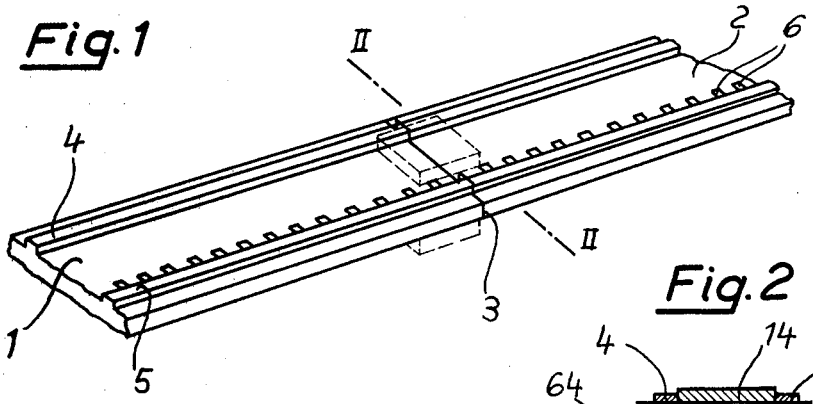
FIG. 1 is a fragmentary perspective view illustrating the two ends of two films required to be spliced together.

It will be understood that in the drawings certain of the thicknesses are shown to an exaggerated extend to enable the invention properly to be understood, and for ease of illustration. Thus, in practice, the relative thicknesses of certain of the parts may not conform precisely with what is illustrated.

Referring firstly to FIG. 1, the ends of two films 1 and 2 that are to be spliced together are brought into accurate and flush abutment at their ends as indicated by the numeral 3. The films are provided with sound tracks 4 and 5, which are shown considerably thicker than they are in reality. The films 1, 2 have customary stepping holes 6.

Figure 3:
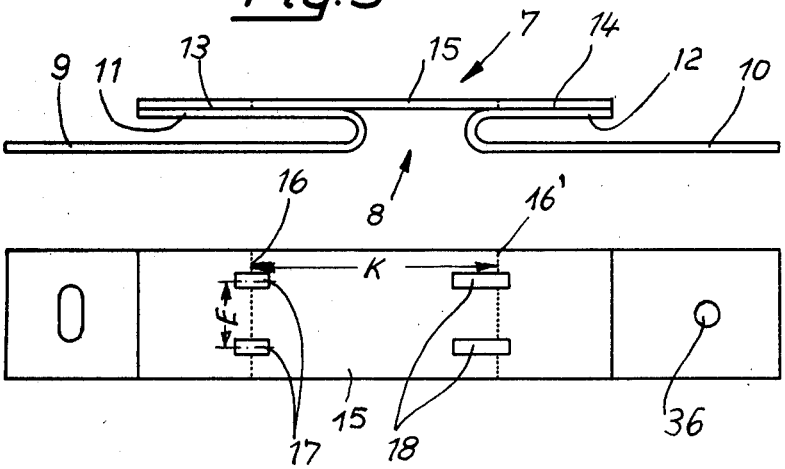
FIG. 3 illustrates, in elevation and in plan, an adhesive foil assembly suitable for use in splicing together the ends of films such as the films shown in FIG. 1, in the manner illustrated in FIG. 2.
Figure 4:
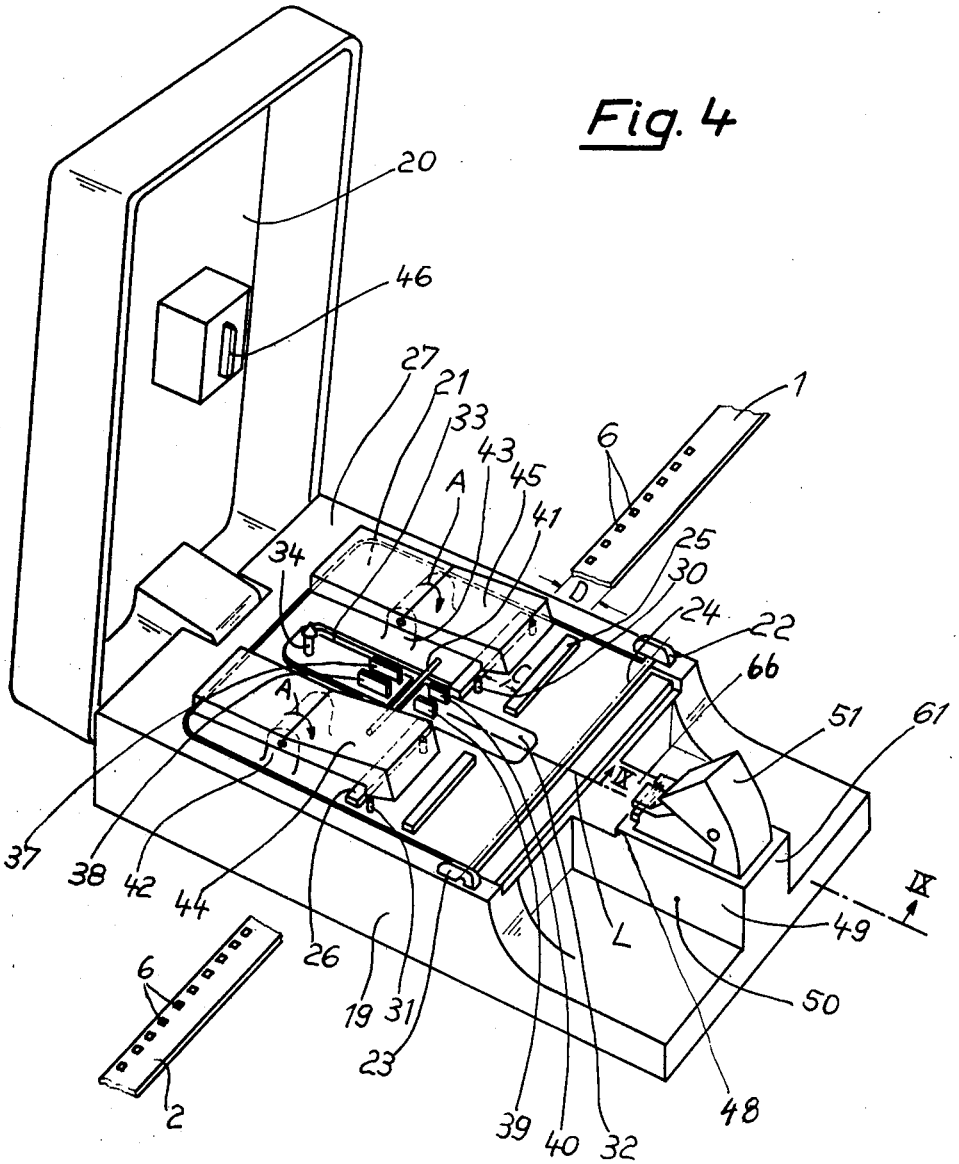
FIG. 4 is a diagrammatic perspective view, to a smaller scale than FIGS. 1 to 3, illustrating a preferred embodiment of the splicing apparatus of the invention.

An ahesive foil assembly, as illustrated in FIG. 3, serves for the production of an adhesive spliced joint between the films 1 and 2 using the splicing apparatus of FIG. 4. As shown in FIG. 3, each adhesive foil assembly 7 consists of a self-adhesive element, in the form of an adhesive foil 8, and two carrier paper strips 9 and 10 which are each folded in a respective hairpin configuration so as to have short limbs 11 and 12 to which the adhesive foil 8 adheres by respective adhesive sections 13, 14. Intermediate portion 15 of the foil 8, between the sections 13 and 14, is free of adhesive. This intermediate portion 15 is detached at the end of the splicing operation. It thus constitutes a tear-off strip. So that the detaching occurs at the correct locations, perforations 16, 16' are provided at respective connection lines between the intermediate portion 15 and the adhesive sections 13 and 14. Additionally, holes 17 and 18 are present in the adhesive foil assembly 7. These holes 17 and 18 have the same spacing pitch E as the stepping holes 6.

The splicing apparatus (FIG. 4) comprises a base 19 having a lid 20 hingedly mounted thereon. The flap 21 is mounted for swinging movement in bearings 22, 23 provided on the top of the base 19. The flap 21, which comprises basically a substantially planar plate, embodies a guide, extending parallel to axis 24 about which the flap 21 can be swung, for the reception of the films 1 and 2 that are to be joined together. This guide is formed by flat rails 25 and 26 which are arranged parallel to one another on the top of the flap 21. To be understood by the term "top" in relation to the flap 21 is that side of the flap 21 which lies upwards in the initial position, shown in FIG. 4, of the flap 21. The spacing C between the flat rails 25, 26 is slightly greater than the width D of the films 1 and 2 that are to be joined together. Top surface 27 of the base 19 is substantially flat, save for a depression 28 into which the flap 21 can so enter that its top lies flush with and in a common plane with the top surface 27.

Situated in the guide, formed by the flat rails 25, 26, for the films 1 and 2 are, in addition, location pins or prongs 30 and 31 onto which the films 1 and 2 can be located by their stepping holes 6 when the films 1 and 2 are placed onto the flap 21 as a preliminary step, ready for splicing. Arranged at a right angle to the swivel axis 24 on the base 19, within the depression 28, is a longitudinally-extending upwardly-projecting projection 32, the top of which lies in a common plane with the top surface 27. So that the flap 21 can assume the initial position shown in FIG. 4, a window 33 is provided in the flap 21 in a position such that when the flap 21 is in the position shown in FIG. 4, the projection 32 enters freely therein.

Situated on the projection 32 is a freely upwardly-projecting peg 34 having an undercut 35 (FIG. 7) which serves for holding an adhesive foil assembly 7 by engagement with a hole 36 in the carrier paper strip 10 (See FIG. 3).

Situated on the projection 32 are, furthermore, upwardly projecting prongs 37, 38 or 39, 40 respectively, which prongs co-operate with respective holes 17 and 18 in the adhesive foil assembly 7 (FIG. 3). Between the prong pairs 37, 38 and 39, 40 a cylindrical pin 41, fastened to the flap 21, extends across the window 33. This pin 41 extends substantially parallel to the axis 24.

Provided on the top of the flap 21, in the initial position shown in FIG. 4, are, in addition, two clamping fingers 44 and 45 which are mounted for swinging movement on bearing blocks 42, 43. These clamping fingers 44, 45 serve to restrain the films 1 and 2 after their insertion into the splicing apparatus, being swung in the direction of the arrows A (FIG. 4) for this purpose. In the so swung position, they remain, as a result of spring pressure, in resilient engagement with the films 1 and 2, and hold these firmly in position on the flap 21.

On the lid 20, there may additionally be a knife 46 by means of which the films 1 and 2 can be cut simultaneously to produce the abutting ends 3 at a right angle to the lengths of the films.

Figure 5:
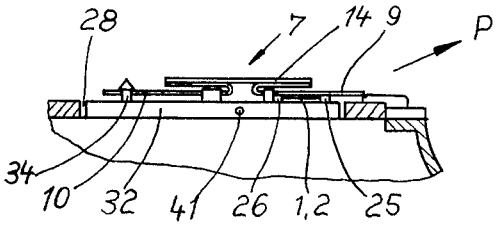
FIG. 5 is a sectional detail of part of the apparatus of FIG. 4 showing an adhesive foil assembly according to FIG. 3 set in place thereon ready for commencement of a splicing operation.

In order to produce a spliced joint between the films 1 and 2, these films 1 and 2 are so applied to the flap 21, in dispositions which will be evident from FIG. 4, that their abutment point comes to rest on the longitudinal central plane L of the base 19, within the guide formed by the flat rails 25 and 26 (FIG. 5). Then an adhesive foil assembly 7 is engaged by the hole 36 in its carrier paper strip 10, over the peg 34, as is evident from FIG. 5, so that the adhesive foil assembly 7 extends approximately at a right angle to the films 1, 2. This position, which is shown in FIG. 5, having been reached, the carrier paper strip 9 is drawn off manually, by pulling it approximately in the direction of the arrow P. As a result the adhesive section 14 is exposed and this comes into contact with the top side of the films 1, 2 in the region of and at each side of the abutment point 3 and adheres to the films 1, 2.

Figure 6:
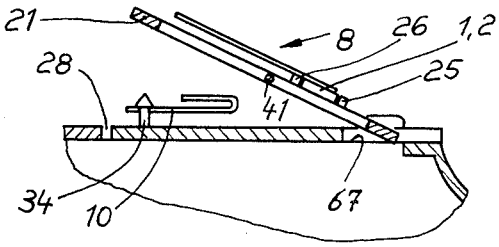
FIG. 6 is a view similar to FIG. 5 but illustrating an intermediate phase in the splicing operation.

Now the flap 21 is swung upwards in the clockwise direction (FIG. 6). When this is done, the carrier paper strip 10 remains attached to the peg 34, since it cannot slide off because of the undercut 35. Upon complete reversal of the flap 21 (FIG. 7), the adhesive foil is forced by the pin 41 against a vertically upwardly extending edge 47 of a ledge 48, disposed parallel to the axis 24, of a shoulder 49 on the base 19. Consequently the free limb 8' of the adhesive foil 8 is bent away in such a way that it extends upwardly, approximately as has been shown in FIG. 7. The distance M of the edge 47 from the swivel axis 24 is greater, by the thickness of the adhesive foil 8 and by a slight clearance, for example of the order of mgnitude of the thickness of writing paper, than the greatest distance N of the pin 41 from the swivel axis 24. The distance N corresponds approximately to half the length K of the tear-off strip 15. Top surface 66 of the shoulder 49 lies approximately in a common plane with bottom surface 67 of the depression 28.

Figure 9:
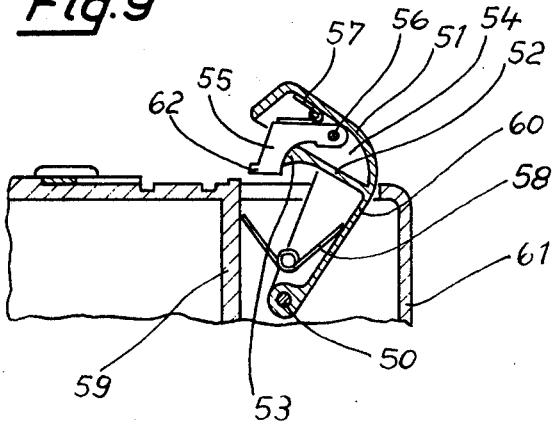
FIG. 9 is a fragmentary sectional elevation taken along the line IX—IX of FIG. 4.

Provided for completing the splicing of the films 1 and 2 is a presser 51 which is mounted for swinging movement in the base 19 at 50 (FIGS. 4 and 9). This presser 51 is hollow in form (FIG. 9). Integral with its rear wall 60 is a solid web 52 which terminates in a wedge 53. In the interior of the presser 51, an angular pressure stirrup 55 is mounted at 56 between side walls 54 of the presser 51 for swinging movement. A first two-armed spring 57 which is arranged between the upper wall of the presser 51 and the presser stirrup 55 loads the pressure stirrup 55 downwards at all times. In the position shown in FIG. 9, the downwardly-forced stirrup 55 abuts against the wedge 53. The wedge 53 thus limits the anti-clockwise (as viewed in FIG. 9) swivel movement of the pressure stirrup 55.

A second two-armed spring 58 between wall 59 of the base 19 and the rear wall 60 of the presser 51 loads the presser 51 towards front wall 61 of the shoulder 49.

Figure 7:
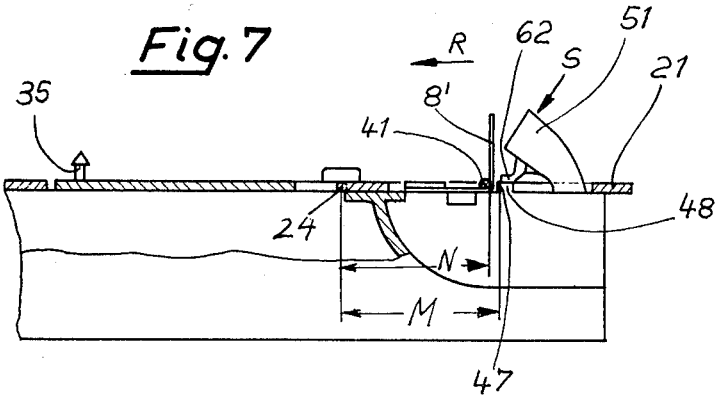
FIG. 7 is a view comparable with FIGS. 5 and 6, but showing slightly more of the splicing apparatus and showing a later phase in the splicing operation.
Figure 8:
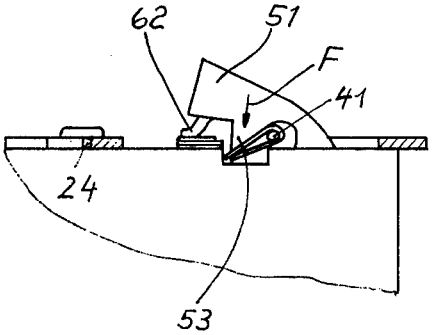
FIG. 8 is a view comparable with FIGS. 5 to 7, but showing the parts at the end of the splicing operation.
Figure 8A:
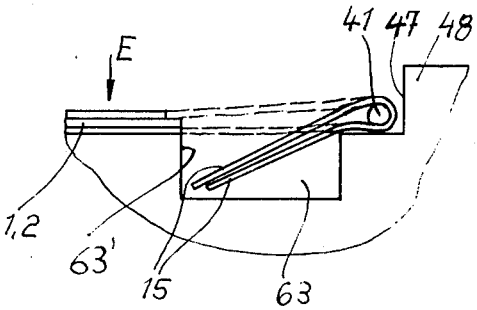
FIG. 8*a* is an enlarged detail of part of FIG. 8.

When the formation of the adhesive joint has reached the phase illustrated in FIG. 7, the presser 51 is forced by hand in the direction of the arrow S. When this is done, a shoe 62 on the pressure stirrup 55 engages free limb 8' of the adhesive foil and, by moving in the direction of the arrow R, takes this free limb 8', around the pin 41, so that the free limb 8' comes to rest with its adhesive section 13 engaging the undersides of the films 1 and 2. At the same time, the assembly consisting of films 1 and 2 and the adhesive sections 13, 14 of the adhesive foil is pressed securely together as indicated by the arrow E in FIG. 8*a*. There thus obtained, at each side of the abutting ends of the films 1 and 2, a secure adhesive joint.

Upon the swinging of the presser 51 in the direction of the arrow S, the downwardly-directed limb of the pressure stirrup 55 is lifted away from the wedge 53, because the shoe 62 comes into abutment against the free limb 8' of the adhesive foil. Upon continued forward movement of the shoe 62 in the direction of the arrow R, the wedge 53 approaches a groove 63, and engages the intermediate portion or tear-off strip 15 which by now extends around the pin 41 and is folded back on itself and is two-layered. Upon pressing the presser 51 further in the direction of the arrow F, the pressure pressing the tear-off strip 15 towards the groove 63 becomes so great that it forces the tear-off strip 15 into the groove 63 at the edge $63^1$. Consequently the tear-off strip 15 is separated from the rest of the foil along the perforations 16, 16'.

Figure 2:
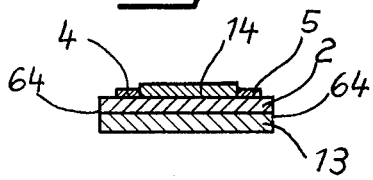
FIG. 2 is a cross-section taken along the line II—II of FIG. 1 after the film ends have been spliced together.

The presser 51 is now released and the flap 21 is swung back into the initial position shown in FIG. 4. The clamping fingers 44, 45 are swung back into the starting position evident from FIG. 4, whereupon the film joint can be removed from the splicing apparatus. As a result of the splicing operation, an adhesive connection such as is shown in cross-section in FIG. 2 is obtained. As can be seen from this figure, the films 1 and 2 are connected securely on the sound-track side by means of the adhesive section 13 and on the opposite side by means of the adhesive section 14. Narrow edges 64 and 65 (FIG. 2) of the films 1 and 2 are completely free of any component of the adhesive foil assembly. Also the tops of the sound tracks 4 and 5 are completely free of any connecting material.

I claim:

1. Apparatus for splicing together the abutting ends of two films by means of an adhesive foil having a tear-off strip and which can be folded back on itself in hairpin configuration to provide two leaves overlying the abutting ends of said films from opposite sides thereof, which adhesive foil, prior to application to said film ends, being supported on removable carrier paper strips, said apparatus comprising a base having a level top surface in which is a depression, and a projection upstanding from the bottom of said depression, a flap connected to said base for swinging movement, about a pivot axis, between an initial position lying in said depression in said base with its upper surface flush with said top surface of said base and an inverted position displaced through an angle of about 180° about said pivot axis from said initial position, a window in said flap for entry therein of said projection when said flap is in its said initial position, a film guide on said flap, upwardly-projecting prongs on said flap for engagement thereof of said adhesive foil by corresponding holes in said foil at each end of its said tear-off strip, a pin carried by said flap, said pin extending substantially parallel to said pivot axis and traversing said window, a shoulder provided on said base so as to be disposed to the side of said pivot remote from said depression, a ledge disposed on said shoulder and defining, with a substantially upright side of said shoulder, an edge which extends substantially parallel to said pivot axis, said edge being spaced from said pivot axis by a distance (M) equal to the sum of the distance (N) between said pin and said pivot axis (which distance N corresponds approximately to half of the length of said tear-off strip) together with the thickness of said adhesive foil and a slight clearance, said shoulder having an upper surface which is coplanar with the bottom surface of said depression, and said upright side and ledge serving as a stop which, upon swinging said flap, with an adhesive foil positioned on its prongs, serve to cause erection of a free limb of said adhesive foil.

2. Apparatus as set forth in claim 1, further including a presser mounted for swingng movement on said shoulder, which presser which serves to bend-over said free limb of said adhesive foil into said hairpin configuration, said presser being so positioned that, when the flap is swung through 180° from its initial position, it freely penetrates said window, a pressure stirrup carried by said presser, and mounted for swinging movement on the presser, a spring acting on said stirrup to force it outwardly, said pressure stirrup having a shoe and being swingable, with its shoe, against the action of a spring, towards said ledge which serve for the erection of said free limb of said adhesive foil, whereby said shoe initially comes into abutment against said free limb of said adhesive foil and upon the further swinging of said presser in the same direction bends said free limb over into said hairpin configuration and slides over said bent-over limb whilst pressing thereon.

3. Apparatus as set forth in claim 2, further including a rigid wedge situated on said presser and having a tip which points towards said upper surface of said shoulder and which co-operates with an upwardly-open groove provided in said shoulder in such a way that upon swinging of the presser in the direction of said pivot axis of said flap after bending-over of said free adhesive foil limb and pressing thereof onto said films by said shoe, and penetrates into said groove thereby to detach said tear-off strip, encircling the pin, from the rest of said adhesive foil.

4. Apparatus as set forth in claim 3, characterised in that said presser is hollow in form and includes a web, integral with its back wall, terminating in the wedge.

5. Apparatus as set forth in claim 4, that said pressure stirrup is mounted in the interior of said presser.

6. Apparatus as set forth in claim 5, further including a spring loading the pressure stirrup outwardly.

* * * * *